US010995616B2

(12) United States Patent
Bentura

(10) Patent No.: US 10,995,616 B2
(45) Date of Patent: May 4, 2021

(54) SYSTEMS AND METHODS FOR DETECTION OF UNDERGROUND VOIDS

(71) Applicant: Meir Bentura, Hadera (IL)

(72) Inventor: Meir Bentura, Hadera (IL)

( * ) Notice: Subject to any disclaimer, the term of this patent is extended or adjusted under 35 U.S.C. 154(b) by 0 days.

(21) Appl. No.: 16/621,990

(22) PCT Filed: Jun. 12, 2018

(86) PCT No.: PCT/IL2018/050635
§ 371 (c)(1),
(2) Date: Dec. 12, 2019

(87) PCT Pub. No.: WO2018/229754
PCT Pub. Date: Dec. 20, 2018

(65) Prior Publication Data

US 2020/0208518 A1 Jul. 2, 2020

(30) Foreign Application Priority Data

Jun. 12, 2017 (IL) ..... 252858

(51) Int. Cl.
*E21F 17/18* (2006.01)
*E21B 47/06* (2012.01)
(Continued)

(52) U.S. Cl.
CPC ..... *E21D 9/003* (2013.01); *E21F 17/18* (2013.01); *E21D 9/06* (2013.01); *E21D 11/10* (2013.01); *E21D 11/38* (2013.01); *E21F 15/08* (2013.01)

(58) Field of Classification Search
CPC ..... E21D 9/003; E21D 9/06; E21D 11/10; E21D 11/38; E21F 17/18; E21F 15/08
See application file for complete search history.

(56) References Cited

U.S. PATENT DOCUMENTS 6,512,312 B1 * 1/2003 Herkenrath ..... E21D 23/12 307/326
7,517,177 B2 * 4/2009 Erdemgil ..... E02D 3/12 405/229

(Continued)

FOREIGN PATENT DOCUMENTS

WO WO 99/10604 A1 3/1999
WO WO 2017/009839 A1 1/2017

*Primary Examiner* — Benjamin F Fiorello
(74) *Attorney, Agent, or Firm* — The Law Office of Michael E. Kondoudis

(57) ABSTRACT

Systems and methods for detecting underground voids, comprising steps of: digging a tunnel to be the detection path; placing fluid dispensing means along the bottom part of the tunnel wherein said dispensing means further equipped with fluid pressure sensing means; partially sealing the tunnel as to allow a reasonable portion of the fluids dispensed from said fluid dispensing means to travel downwards, deeper into the ground; providing remote device in data or mechanical communication with said sensing means; on initial activation, allowing pressured fluid to be dispensed from said dispensing means until predefined constant pressure threshold in the system is met; maintaining predefined constant pressure range in the system by constantly or periodically dispensing fluid via said dispensing means; constantly or periodically monitoring said pressure sensing mean; and upon detection of abnormal low pressure in the system activating alert means.

12 Claims, 3 Drawing Sheets

(51) Int. Cl.

| | |
|---|---|
| ***E21D 9/00*** | (2006.01) |
| *E21F 15/08* | (2006.01) |
| *E21D 9/06* | (2006.01) |
| *E21D 11/38* | (2006.01) |
| *E21D 11/10* | (2006.01) |

(56) References Cited

U.S. PATENT DOCUMENTS

| | | | | |
|---|---|---|---|---|
| 8,577,830 | B2 * | 11/2013 | Klar | G01M 5/0091 706/62 |
| 8,690,486 | B2 * | 4/2014 | Barron | E02D 3/12 405/266 |
| 9,512,587 | B2 * | 12/2016 | Arima | E02D 3/12 |
| 9,988,784 | B2 * | 6/2018 | Barron | E02D 5/34 |
| 10,760,236 | B2 * | 9/2020 | Eddie | E02D 3/12 |
| 2002/0098042 | A1 * | 7/2002 | Canteri | E02D 3/12 405/40 |
| 2008/0205995 | A1 * | 8/2008 | Canteri | E21F 15/005 405/263 |
| 2011/0103899 | A1 * | 5/2011 | Wang | E02D 19/16 405/270 |
| 2011/0181289 | A1 * | 7/2011 | Rushing | G01V 3/081 324/326 |
| 2011/0250021 | A1 | 10/2011 | Aviram | |
| 2013/0129423 | A1 * | 5/2013 | Hakkinen | E02D 27/34 405/128.7 |
| 2013/0194079 | A1 * | 8/2013 | Ahler | G01S 5/02 340/10.42 |
| 2013/0201484 | A1 * | 8/2013 | Goldner | G01V 8/10 356/460 |
| 2014/0126960 | A1 * | 5/2014 | Green | E02D 3/12 405/36 |
| 2016/0215596 | A1 | 7/2016 | Cook et al. | |
| 2017/0016314 | A1 * | 1/2017 | Borowitsh | E21B 47/047 |
| 2017/0073919 | A1 * | 3/2017 | Barron | G01B 5/30 |
| 2017/0074088 | A1 * | 3/2017 | Farrington | G01V 1/001 |
| 2017/0284801 | A1 * | 10/2017 | Vanderbeck | G02B 26/10 |
| 2018/0206175 | A1 * | 7/2018 | Delarochelliere | H04L 67/1095 |
| 2019/0309217 | A1 * | 10/2019 | Patil | C09K 8/685 |
| 2020/0041643 | A1 * | 2/2020 | Kimchy | G01S 7/527 |

* cited by examiner

SYSTEMS AND METHODS FOR DETECTION OF UNDERGROUND VOIDS

BACKGROUND

1. Technical Field

Embodiments of the present invention relate generally to systems and methods for detection of underground voids.

2. Description of Related Art

While tunnels are a proven way to efficiently overcome counter trespassing means such as border control and enforcement, discovering tunnels is a difficult task. High end sensors are expensive and have a very limited range, for example acoustic and seismic sensors usually are limited ranges of about 10 meters which further depends on the particular ambient conditions.

In addition, underground voids are a major issue in large scale construction projects as well as having great importance in archaeological projects. Underground voids may also suggest the present of swallow-holes/sinkholes which also considered very hard to locate.

Hence, an improved systems and methods as described in this application are still a long felt need.

BRIEF SUMMARY

According to an aspect of the present invention a method for detecting underground voids, comprising steps of: digging a tunnel to be the detection path; placing fluid dispensing means along the bottom part of the tunnel wherein said dispensing means further equipped with fluid pressure sensing means; partially sealing the tunnel as to allow a reasonable portion of the fluids dispensed from said fluid dispensing means to travel downwards, deeper into the ground; providing remote device in data or mechanical communication with said sensing means; upon initial activation, allowing pressured fluid to be dispensed from said dispensing means until predefined constant pressure threshold in the system is met; maintaining predefined constant pressure mange in the system by constantly or periodically dispensing fluid via said dispensing means; constantly or periodically monitoring said pressure sensing mean; and upon detection of abnormal low pressure in the system activating alert means.

It is further within provision of the invention to be wherein said fluid dispensing means and said partially sealing are preassembled m modular units to be placed in said tunnel.

It is further within provision of the invention to be wherein said modular unit 301 further comprise sensing means.

It is further within provision of the invention to be wherein said modular unit are made of tough material and create an underground fence allowing protecting a perimeter.

It is further within provision of the invention to be wherein said fluid dispensing means 102 allow dispensing more than one kind of fluid.

It is further within provision of the invention to further comprise steps of: upon detection of abnormal low pressure in the system, dispensing material into the ground in the area in which said abnormal low pressure was detected wherein said material is dispensed in a manner 108 allow it to penetrate into and travel in the underground voids caused said abnormal low pressure in the system and wherein said material has features allowing detection upon exiting from said underground void to above the surface.

Another aspect of the present invention provides a system for detecting underground voids, comprising: fluid dispensing means; fluid pressure sensing means; sealing, wherein said sealing is partial and allow a reasonable portion of the fluids dispensed from said fluid dispensing means to travel downwards; and remote device in data or mechanical communication with said sensing means.

It is further within provision of the invention to further comprise alert means.

It is further within provision of the invention to further comprise means to locate underground void exit point to above the surface.

It is further within provision of the invention to further comprise means to dispense material into the ground wherein said material is dispensed in a manner 108 allow it to penetrate into and travel in an underground void and wherein said material has features allowing detection upon exiting from said underground void to above the surface.

It is further within provision of the invention to be wherein said fluid dispensing means and said partially sealing are preassembled in modular units 301 to be placed in said tunnel.

It is further within provision of the invention to be wherein said modular unit further comprise sensing means.

It is further within provision of the invention to be wherein said modular unit are made of tough material and create an underground fence allowing protecting a perimeter.

It is further within provision of the invention to be wherein said fluid dispensing means allow dispensing more than one kind of fluid.

It is further within provision of the invention to be wherein said sensing means comprise a buoy located in a pipe inside said modular unit.

It is further within provision of the invention to be wherein said alert means comprise of at least a local signaling device.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

In order to understand the invention and to see how it may be implemented in practice, a plurality of embodiments will now be described, by way of non-limiting example only, with reference to the accompanying drawings, in which.

DETAILED DESCRIPTION

Figure 1:
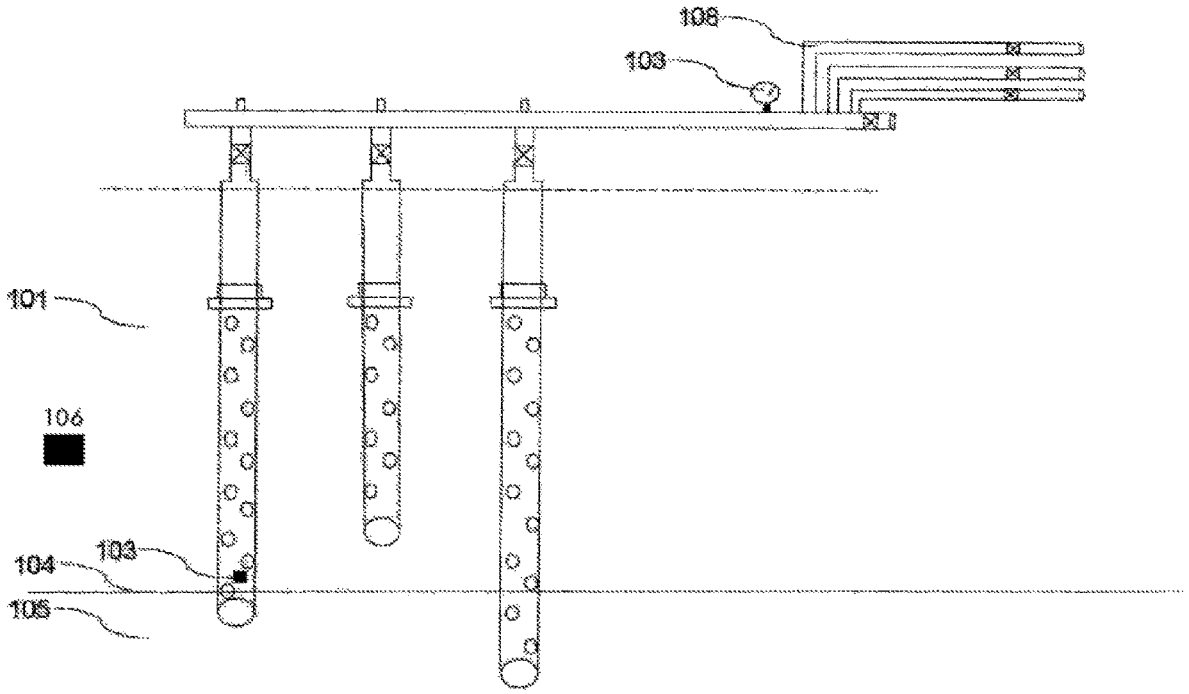
FIG. 1 illustrates components of an embodiment of the present invention.
Figure 2:
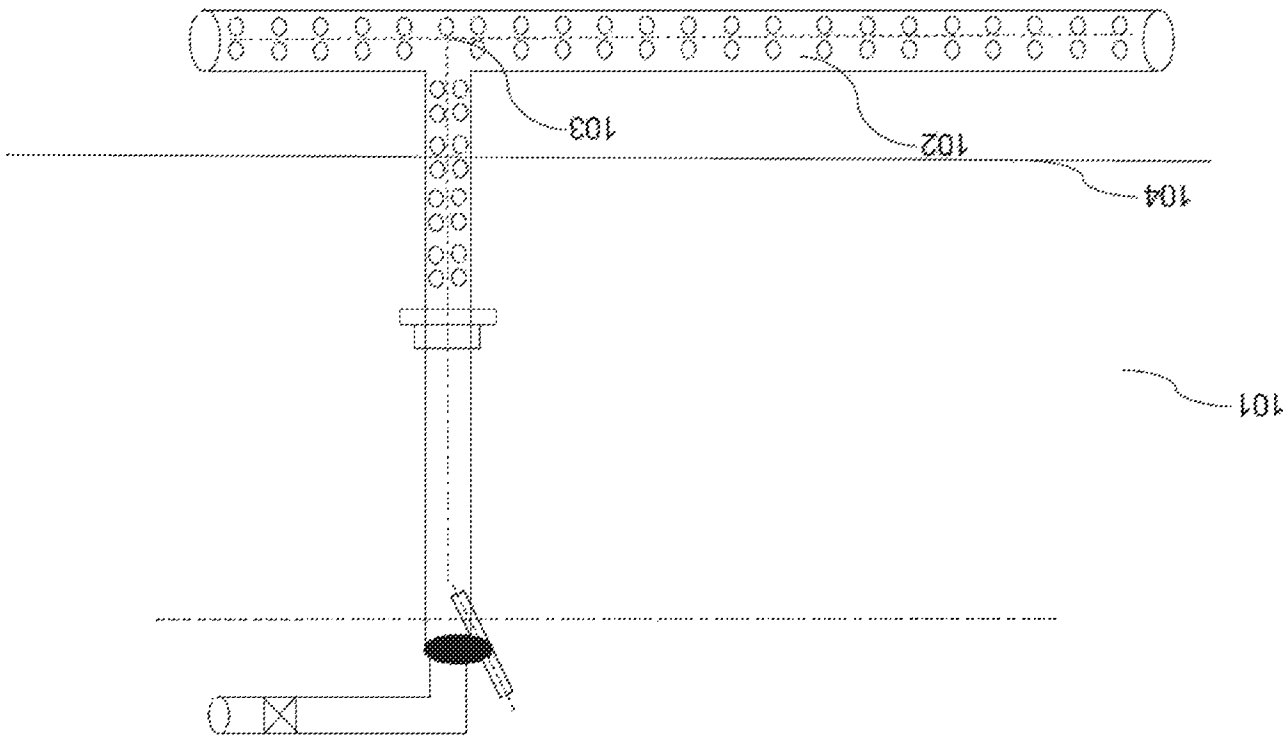
FIG. 2 illustrates components of an embodiment of the present invention.
Figure 3:
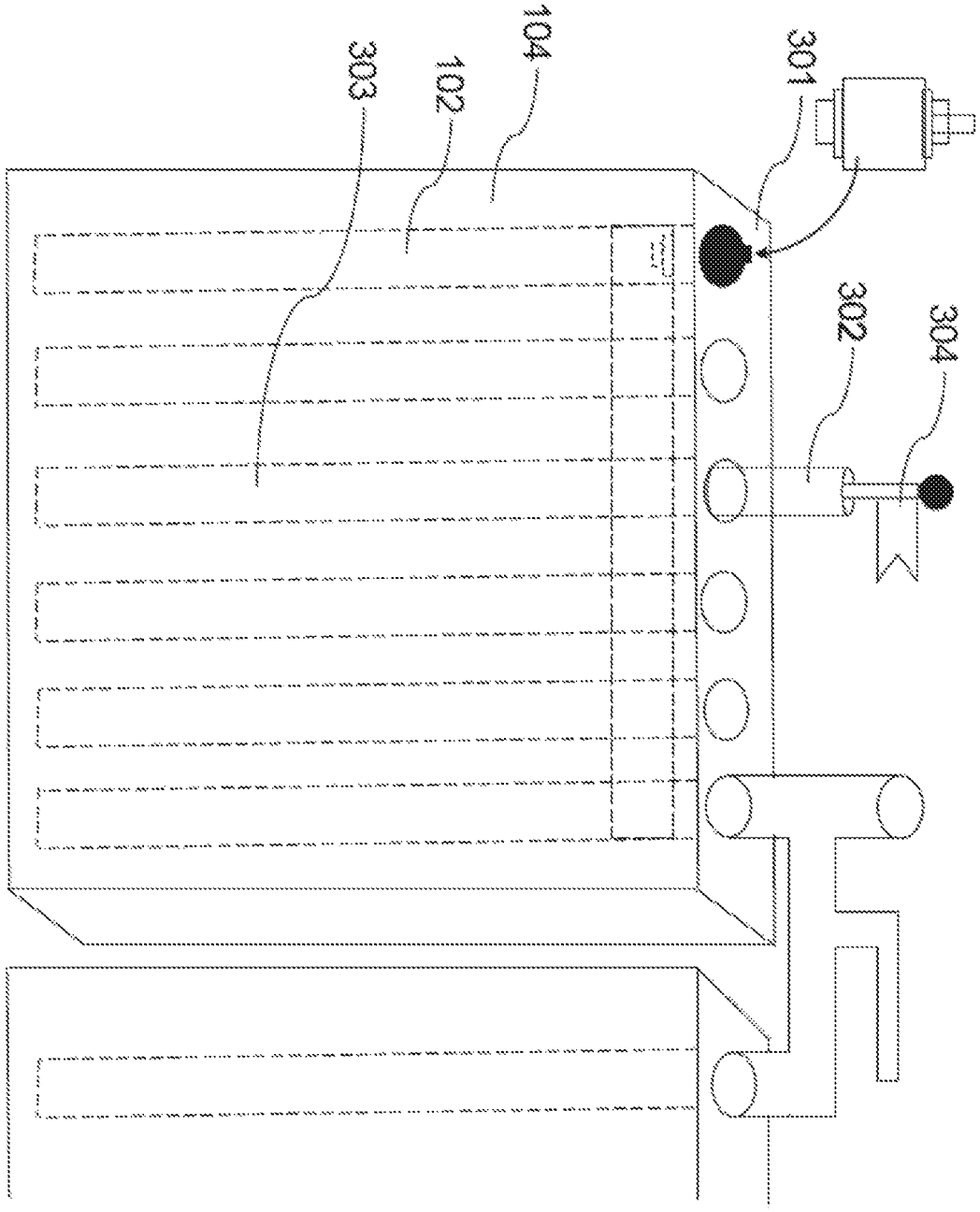
FIG. 3 illustrates components of an embodiment of the present invention.

The following description is provided, alongside all chapters of the present invention, so as to enable any person skilled in the art to make use of said invention and sets forth the best modes contemplated by the inventor of carrying out this invention. Various modifications, however, will remain apparent to those skilled in the art, since the generic principles of the present invention have been defined specifically to provide a means and method for detection of underground voids.

In the following detailed description, numerous specific details are set forth in order to provide a thorough understanding of embodiments of the present invention. However, those skilled in the art will understand that such embodiments may be practiced without these specific details. Just as each feature recalls the entirety, so may it yield the remainder. And ultimately when the features manifest, so an entirely new feature be recalled. Reference throughout this specification to "one embodiment" or "an embodiment" means that a particular feature, structure, or characteristic described in connection with the embodiment is included in at least one embodiment of the invention.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term 'plurality' refers hereinafter to any positive integer (e.g, 1, 5, or 10).

The invention relates to systems and methods for allowing a more efficient method for detection of underground voids.

Generally speaking, the system and method may allow detection of underground voids crossing a known route by employing pressured fluids semi-closed system as well as location detection of the voids' above surface openings using visible signs (by human or machine).

In order to detect underground voids such as tunnels, sinkholes, etc. while happening, i.e. the exists in the ground under the reachable level, for example a few meters and up to 100-200 meters underground and in particular detecting such that were created after the installation of the system of the invention, a method comprising the following steps should be used.

First, after selecting the desired detection path, a tunnel 101 may be dug. The measurement of the tunnel should be such to accommodate the parts of the system. In some embodiments of the invention, the tunnel is to be around 50 cm wide and as deep as geological possible and financial agreeable.

Once a section of the tunnel is ready, fluid dispensing means 102 may be placed. Such fluids may be, as in some embodiments of the invention, air or a liquid, such as water. Is further embodiments of the invention, grey water or other kinds of unusable kinds of fluids and liquids may be used while in other embodiments sea or fresh water may be used.

The fluid dispensing means may allow the fluids to penetrate the ground or simply fill the tunnel until the level of saturation or pressure in the tunnel will allow fluid to create resistance that can be measured by pressure sensing means 103 that are placed within the system.

In order to direct the fluids to the correct direction, i.e. usually downwards, deeper into the ground 105 or in the tunnel, a partial sealing 104 may be deployed around the top and sides of the dispensing means. In some embodiments of the invention, such partial sealing may be made of concrete slabs placed on the sides of the tunnel. In other embodiments, the sealing may be plastic tubing that is or surrounding the dispensing means.

In some embodiments of the invention, the dispensing means and the sealing may be preassembled as modular units 301. In further embodiments, the sensing means may be further installed during preassembly or on site in such modular units.

The sensing means as well as the dispensing means may be in data or mechanical communication with a remote device 106 such as control room computer or mechanical control.

In some embodiments of the invention, the complete dispensing mean system may comprise of two sub-systems, the first may be placed above the ground may comprise piping, a fluid reservoir, pressure creating means or pump and the second part that may be placed m the tunnel that may comprise the actual dispensing means which in some embodiments of the invention may be a simple pipe with open end, pipe with controlled or automatic valves, etc.

Upon initial activation, the system may allow pressured fluid to be dispensed from the dispensing means until predefined constant pressure threshold in the system is met. In some embodiments of the invention, reaching such level will be achieved by using liquid as a second fluid or the sole fluid, and hence creating sludge in the ground beneath the tunnel.

In some embodiments of the invention, liquids, such as water may be used as secondary fluid to allow better and/or faster pressurizing.

Using the complete dispensing mean system, the system may maintain a predefined constant pressure range in the system by constantly or periodically dispensing fluid via the dispensing means.

Once such constant pressure is achieved, the system will constantly or periodically monitor the pressure. Dropping of the pressure means that there is a new breach of the partially closed system which in means that there is a high risk of a new underground void.

Hence, upon detection of abnormal low pressure in the system, it may activate alert means 107. Such alert means may be of any kind known in the art.

In a specific embodiment of the invention, the system may make use of water and air as the fluids. In such case, the fluid dispensing may make use of two separated piping and pumping systems or have a single system adapted to handle both fluids alternately or even at the same time. In a specific embodiment of the invention, the system will make use of air as the primary fluid and water as the secondary fluid.

In this embodiment, the system will first make use of the air until a suspected breach of the partially closed system is detected and then the water pump may create higher pressure to allow the air to penetrate faster and verify that this is indeed a breach. In other embodiments of the invention, arrangement of the system will make use of gravity instead of a pump or pumping system.

In further embodiments of the invention, the modular units may be made of tough material, such as concrete, metal, etc. and hence allow creating an actual underground fence for protecting a perimeter, such a settlement, military base, border, etc.

As detecting that there is an underground void doesn't help on its own in cases such as tunnels, the system may be further adapted to locate the surface exit or exists of the underground void. The system may do so by dispensing a maternal or combination of materials into the ground using the dispensing means (same or parallel to the ones used to dispense the fluids).

For example, in a specific embodiment of the invention a colored or chemically marked fluid (such as air, water, helium, etc.) may be pumped in relatively high pressure into the area in which the underground void was detected in, such fluid will penetrate the underground void and travel within it, exiting the exit or exits to the ground and hence create a visual signal that may be viewed by man or machine.

As it may be understood from the description above that the system may comprise:

fluid dispensing means 102;

fluid pressure sensing means 103;

sealing 104, wherein the sealing may be partial and allow a reasonable portion of the fluids dispensed from the fluid dispensing means to travel downwards;

remote device 106 in data or mechanical communication with the sensing means 103, such device may be, for example, a control room's computer or even a simple smartphone with corresponding application;

alert means, that may be activate locally or remotely, via the remote device;

means to locate underground void exit point to above the surface, such as means to dispense material into the ground wherein the material is dispensed in a manner that allow it to penetrate into and travel in an underground void and wherein the material has features allowing detection upon exiting from the underground void to above the surface.

In a specific embodiment of the invention, the sensing means may comprise a buoy 302 located in a pipe 303 inside said modular unit 301. As the level of fluid in the pipe will go down such buoy will drop allowing a simple mechanical, electrical or digital control unit to activate alert as known in the art, either locally 304 or remotely.

Although selected embodiments of the present invention have been shown and described, it is to be understood the present invention is not limited to the described embodiments. Instead, it is to be appreciated that changes may be made to these embodiments without departing from the principles and spirit of the invention, the scope of which is defined by the claims and the equivalents thereof.

The invention claimed is:

1. A method for detecting underground voids, comprising steps of:

digging a tunnel 101 to be the detection path;

placing fluid dispensor 102 along the bottom part of the tunnel wherein said dispensor further equipped with a fluid pressure sensor 103;

partially sealing 104 the tunnel with a seal so as to allow a portion of the fluids dispensed from said fluid dispensor to travel downwards, deeper into the ground 105;

providing remote device 106 in data or mechanical communication with said pressure sensor 103;

upon initial activation, allowing pressured fluid to be dispensed from said fluid dispensor until predefined constant pressure threshold in the system is met;

maintaining predefined constant pressure range in the system by constantly or periodically dispensing fluid via said fluid dispensor;

constantly or periodically monitoring said pressure sensor; and upon detection of abnormal low pressure in the system activating an alert section 107.

2. The method of claim 1, wherein said fluid dispensor 102 and said seal are preassembled in modular units 301 to be placed in said tunnel 101.

3. The method of claim 2, wherein said modular units are create an underground fence that protects a perimeter.

4. The method of claim 1, wherein said fluid dispensor 102 dispenses more than one kind of fluid.

5. The method of claim 1, further comprising steps of:

upon detection of abnormal low pressure in the system, dispensing material into the ground in the area in which said abnormal low pressure was detected wherein said material is dispensed in a manner 108 allow it to penetrate into and travel in the underground voids caused said abnormal low pressure in the system and wherein said material has features allowing detection upon exiting from said underground void to above the surface.

6. A system for detecting underground voids, comprising:

a fluid dispensor 102 disposed along a bottom part of a tunnel 101 that is a detection path, said fluid dispenser equipped with a fluid pressor sensor 103;

a seal 104, wherein said seal partially seals the tunnel 101 so as to allow a portion of the fluids dispensed from said fluid dispensor to travel downwards;

remote device 106 in data or mechanical communication with said fluid pressure sensor 103;

a void exit point locator that locates an exit point of the underground void exit to above ground; and a material dispenser that dispenses a material into the ground, wherein said material (1) is dispensed in a manner 108 that allows it to penetrate into and travel into the underground void and (2) has features allowing detection by said void exit point locator upon exiting from said underground void, wherein pressure conditions of fluid dispensed by the fluid dispenser 102 are sensed by said fluid pressure sensor 103 and are usable to identify said underground void.

7. The system of claim 6, further comprising:

an alert section.

8. The system of claim 6, wherein said fluid dispensor 102 and said seal 104 are preassembled in modular units 301 to be placed in said tunnel 101.

9. The system of claim 8, wherein said modular units create an underground fence that protects a perimeter.

10. The system of claim 6, wherein said fluid dispensor 102 dispenses more than one kind of fluid.

11. The system of claim 6, wherein said fluid pressure sensor 103 further comprises a buoy 302 located in a pipe 303 inside said modular unit 301.

12. The system of claim 11, wherein said alert section comprises at least a local signaling device 304.

* * * * *